United States Patent [19]

Berge

[11] Patent Number: 4,844,464

[45] Date of Patent: Jul. 4, 1989

[54] COIN-RELEASED GAMING MACHINE

[76] Inventor: Harald Berge, Bjerkealléen 33, 1322 Høvik, Norway, 1322

[21] Appl. No.: 116,553

[22] Filed: Nov. 3, 1987

[51] Int. Cl.[4] ..... A63F 7/00

[52] U.S. Cl. ..... 273/138 A; 273/143 R; 273/355

[58] Field of Search ..... 273/138 A, 143 R, 1 E, 273/355

[56] References Cited

U.S. PATENT DOCUMENTS

| | | | |
|---|---|---|---|
| 4,448,419 | 5/1984 | Telnaes | 273/143 R |
| 4,624,459 | 11/1986 | Kaufman | 273/143 R |
| 4,657,256 | 4/1987 | Okada | 273/143 R |
| 4,679,143 | 7/1987 | Hagiwara | 273/138 A |

*Primary Examiner*—Leo P. Picard

*Attorney, Agent, or Firm*—Frost & Jacobs

[57] ABSTRACT

A coin-released gaming machine having a number of pay-out slots arranged in a coin panel, into which panel the user shoots a coin to hit one of the pay-out slots, the hitting of one such pay-out slot with a coin triggering a release mechanism to portion out of a certain number of coins stored in the machine for the pay-out of a prize, whereas the missing of any such pay-out slot brings the used coin into a coin store, a control system provides for monitoring the total value of coins paid in, for monitoring the total value of prizes paid out, for setting a long term profit, for setting a long term pay-out prize, and for setting a special pay-out prize larger than the long term pay-out prize.

9 Claims, 4 Drawing Sheets

COIN-RELEASED GAMING MACHINE

FIELD OF THE INVENTION

The present invention relates to a coin-released gaming machine of the type including a number of pay-out slots arranged in a coin panel, into which panel the user shoots a coin to hit one of the pay-out slots, the hitting of one of the pay-out slot with a coin triggering a release mechanism to portion out a certain number of coins stored in the machine for the pay-out of a prize, whereas the missing of any such pay-out slot brings the used coin into a coin store.

BRIEF DESCRIPTION OF THE PRIOR ART

There are previously known such gaming machines which are equipped with mechanical devices for monitoring the payout prizes. Some of these devices are adopted so that there is a fixed pay-out prize for each pay-out slot for example ten coins for hitting the central pay-out slot, whereas the pay-out prize gradualey decreases for, example to three coins for the outermost slot at each edge. Any variation of the pay-out prizes is very difficult to achive, and the adjustment of the long term income/payout relation can only be achieved by manual adjustment of the infeed openings of the slots, which adjustment changes the statistic probability of hitting any slot, and thereby the above ratio. As a rule there is aimed for a long term average income of 20% from the machine, i.e. 80% of what is paid in should be paid out as pay-out prizes over a larger number of games. The infeed area of the slots are therefor adjusted (by trying and failing) for the achivement of the correct per centage. This might be a time consuming prosess.

From Norwegian Patent Specification No. 139758 (Lars Berg A/S) there is known a device in a coin-released gaming machine, comprising a pay-out mechanism which is programmed for continuously or periodically changing the pay-out prize. This pay-out mechanism comprises generally a wheel housed in a housing and being provided with ring-shaped cabinets for coins, said wheel being connected to a motor which starts the wheel in the pay-out mechanism when payment is to be undertaken. Said wheel, including the associated controls as well as the indicating and controlling mechanisms in the known device, comprises an electro mechanical system requiring a plurality of mechanically movable elements, which in-turn require frequent and costly maitenance. Such an electro mechanical system will also increase the probability of fault occurance in the machine. Becides, such an electro mechanical system will render few possibillities of a versatile programming, let alone in connection with nonperiodical variations of the pay-out prizes.

The continuous or periodic changes in the pay-out prizes according to the above Norwegian Patent Specification No. 139758 are implemented by letting the individual display units arranged above each pay-out slot change their value within certain time intervals, at the same time as the pay-out mechanisms are set to the value which at any time is displayed above the slots. Thus, the user of the machine must not only evaluate the strength of the stroke with which the coin is shot, such that one of the slots is hit, but the user must also let the coin hit the selected slot at a point of time securing an optimum pay-out prize. According to said Norwegian Patent Application it is suggested to change the pay-out prize value every second second, such that the user must shoot the coin well in advance of the point of time at which the maximum value is displayed and ready to be paid out.

BRIEF DESCRIPTION OF THE INVENTION

An object of the present invention is to provide a coinrealised gaming machine of the kind set forth, incorporating fewer electro magnetic elements and fewer mechanical parts than compared with prior art machines.

Another object of the present invention is to provide a coin-released gaming machine which can be programmed in a far more versatile and variable manner than compared with previous gaming machines.

Yet another object of the present invention is to provide a coin-released gaming machine in which the short term pay-out prizes and the long term profit are completely supervised and controlled as well as apropriately adjusted.

Still another object of the invention is to provide a coin-released gaming machine giving further possibily ties of variations in the pay-out prizes, especially such pay-out prizes which are of the "jackpot" type.

Another object of the present invention is to provide for a coin-released gaming machine in which it is possible to alter the number of games from one jackpot to the next, and to combine this variation in games with alterations in the value of the long term pay-out prizes as well as in connection with an alteration of the value of the jackpot prizes.

A further object of the present invention is to provide a coin-released gaming machine in which the variation in the number of games from one jackpot to the next is implemented in such a manner that it is practically impossible for a user to expect when the next jackpot prize is ready to be paid out.

An object of the present advention is also to provide a coin-released gaming machine in which the relation between the long term profit, the long term pay-out prize and the special jackpot pay-out prize can be adjusted automatically so as to obtain a correct average ratio between profit and pay-out.

BRIEF DESCRIPTION OF THE INVENTION

These objects are achived in a coin-released gaming machine of the kind set forth in the preamble, which according to the present invention comprises the improvement of means for monitoring the total value of coins paid in, means for monitoring the total value of prizes paid out, means for setting a long term profit, means for setting a long term pay-out prize, as well as means for setting a special pay-out prize being larger than the long term pay-out prize.

In a special embodiment the means for setting a special pay-out prize is adapted to initiate the pay-out of the special jackpot prize according to the occurrance of a randomly varying number of usual long term pay-out prizes.

In yet another embodiment the means for setting the special pay-out prize is adapted to pay out the special jackpot prize not only according to the occurance of a randomly varing number of usual long term pay-out prizes, but also to a varying pay-out prize which can vary below and above the average long term pay-out prize.

BRIEF DISCRIPTION OF THE DRAWINGS

The invention will now be described more closely in the following with reference to the accompanying drawings.

FIG. 1*a* is a diagrammatic front view of a combined coin pennel of a pay-out machine in a front view and a block diagram related thereto of a first embodiment of a payout machine incorporating the present invention.

FIG. 1*b* is a block diagram of the electronic units included in the pay-out machine according to the invention.

FIG. 2*a* is a graph illustrating an example of variations in long term pay-out prizes and jackpot prizes related to a large number of games.

FIG. 2*b* is a graph illustrating another variation of long term pay-out prizes and jackpot prizes related to a large number of games.

DESCRIPTION OF PREFERRED EMBODIMENTS.

Figure 1A:
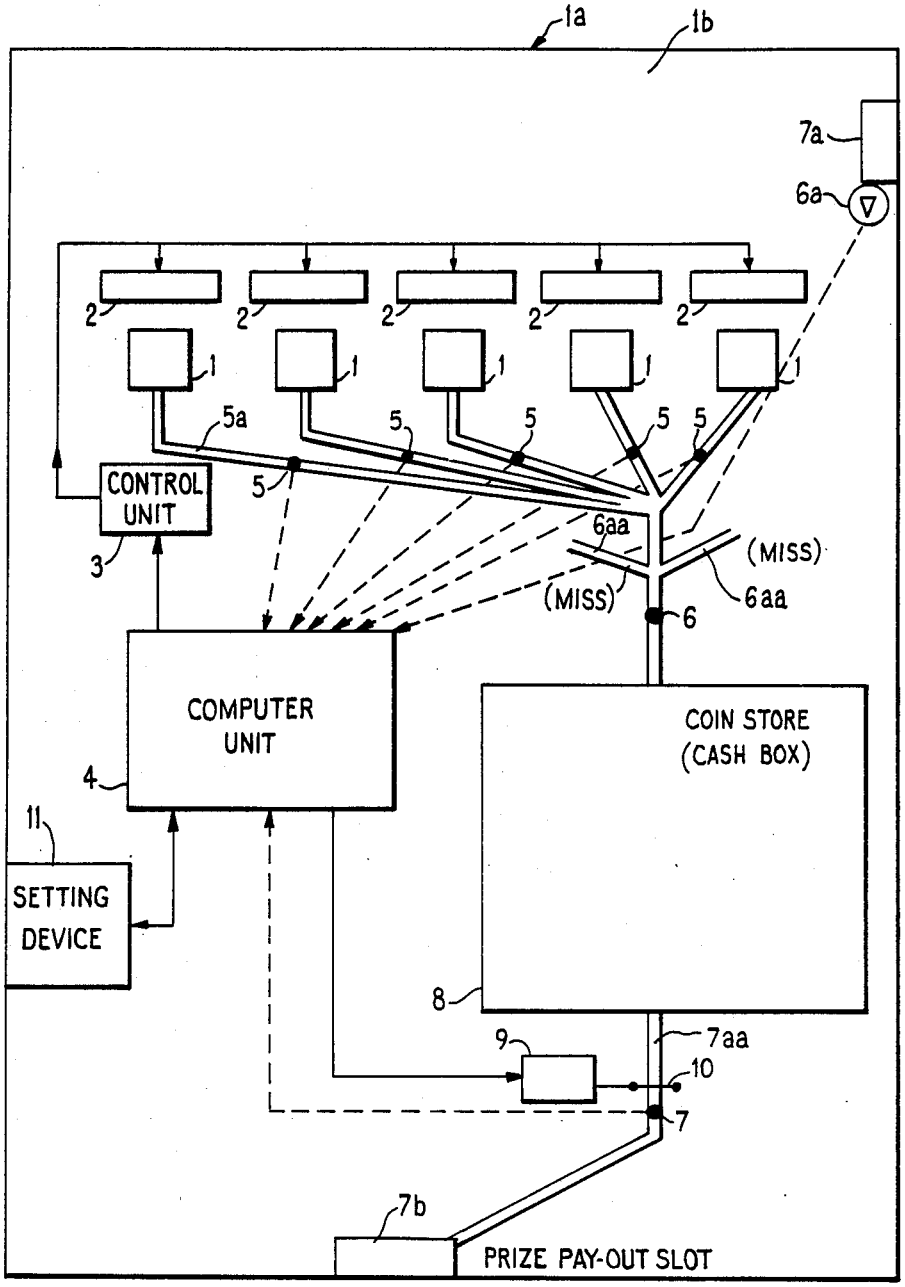

In FIG. 1*a* which illustrates in a diagrammatic way the physical components of a coin-released gaming machine and the individual conection thereof with the various control and monitoring means in a simplified block diagram, the general construction thereof might be of a kind as known per se. The coin-released gaming machine which in FIG. 1*a* is a designated 1*a*, comprises a coin panel 1*b*, which inturn is provided with a plurality of pay-out slots, for example five slots 1, which are adapted as targets for coins which are fed into the machine and which by the user is shot into the panel by means of a hand operated shooting mechanism. Above each target or pay-out slot 1 there is provided a display unit 2 which in a variable manner displays the pay-out prize in question before each game. The display units 2 which can be of a generally known LED or LCD type are controlled from a control unit 3 which in turn reacts to information received from a computer unit 4. The computer unit 4 is adapted to receive information from a plurality of sensors which are provided at various positions in the coin panel 1*b*, and which supervise the movement of the various coins i.e. the stage of coin infeed, the stage of a coin hitting a pay-out slot, a coin missing any pay-out slot, a coin approaching the coins store, or a coin being paid out through the coin store of the machine.

Thus, a first set of sensors 5 supervise any individual outfeed path from a pay-out slot 1, said set of sensors 5 submitting an electrical signal to the computer unit 4 for indicating to the computer unit that a coin has been received in any pay-out slot 1 and that a pay-out prize should be portioned out from the coin store in accordance with the prize in question displayed on the corresponding display unit 2.

After having passed the guiding path 5*a* from a pay-out slot 1 the coin will be collected in a coin store 8, but before it has reached the coin store 8 the coin will pass a sensor 6 which registers all coins being fed into the machine.

If a coin having been fed into the machine and having been shot towards one of the pay-out slots should miss the slots, the coin will follow any intermediate path 6*aa* on its way to the coin store 8 after having been registered by the above sensor 6.

It should be noted that there is also provided an input sensor 6*a* which is located in the vicinity of the infeed slot 7*a* from which the coin fed into the machine, is shot towards the pay-out slots.

It should further be noted that another sensor 7 is provided in the outfeed path 7*a* from the coin store 8, said sensor 7 supervising the number of coins being paid out after a pay-out prize has been awarded, and said outfeed path 7*aa* leading to a prize pay-out slot 7*b*.

In most of the games played by a user of the machine 1*a*, the coin which has been fed into the machine through the infeed slot 7*a* and shot therefrom by means of a not illustrated shooting means, will not hit any of the pay-out slots 1, and will then follow the intermidiate paths 6*aa* to the coin store or cash box 8 after having been registered by the input sensor 6*a* and the coin store supervising sensor 6. Upon hitting a pay-out slot 1 the coin will also pass to the coin store or cash box 8, and also in this case after having been registered by the input sensor 6A and the coin store supervising sensor 6, but in addition the coin which has hit a pay-out slot 1, will pass one of the hit indicator sensors 5, which entails that a signal therefrom is transmitted to the computer unit 4 which immmediately orders a dispenser mechanism 9 to open a locking means 10 in the pathway 7*a* from the coin store 8, so as to open for the paying out of that number of coins which is displayed on the display unit 2 associated with the pay-out slot 1 which received the hitting coin. The control sensor 7 in the outfeed path 7*a* from the coin store 8, not only supervises the total number of coins being paid out through the locking means 10, but also ensures that the correct payment is effected, by sending a control signal back to the computer unit 4.

Figure 1B:
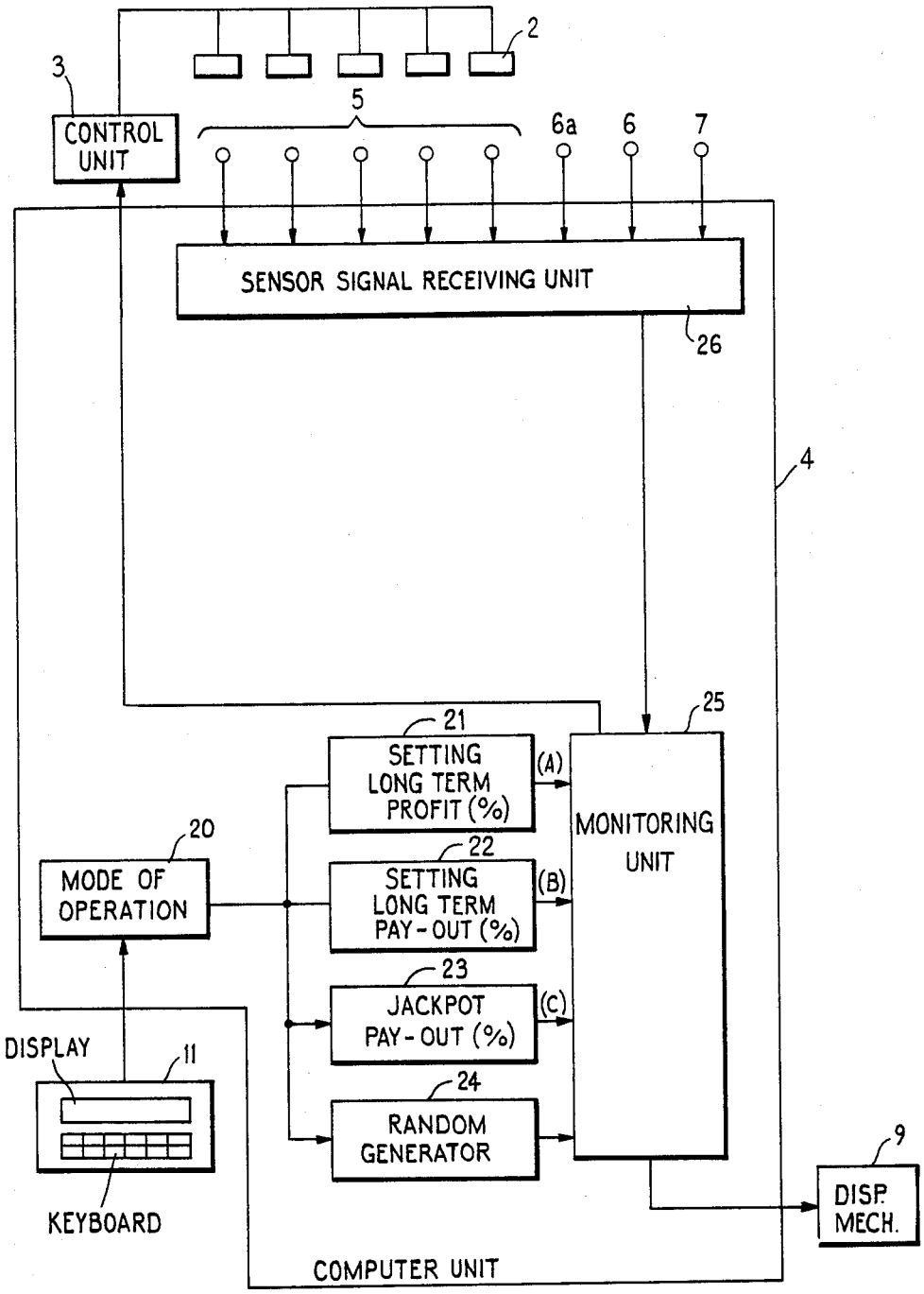

The computer unit 4 is connected to a setting device 11 including a display unit 11*a* and a keyboard 11*b*, as this is further illustrated in the block diagram of FIG. 1*b*. The keyboard 11*b* is used for setting the computer unit 4, and in order to ensure that this setting is made by authorized staff only, the keyboard might be provided with a locking and unlocking key.

The computer unit 4 will continually receive and at any time store information about the contents of the coin store 8. Further, the computer unit 4 has been set so as to adapt the value of the pay-out prize in accordance with the contents of the coin store 8, as this will be further explained in the following.

It is to be understood that the computer unit 4 comprises a superior program which ensures a long time average payout prize of a certain percentage of the total input, this average being denoted B %, and for example constituting 80% of the total input, i.e. a certain percent, here A percent, for example 20% being retained by the machine as profit. However, the computer unit 4 in combination with the setting device 11 allow for a variation of this ratio B/A to be achived in a manner which makes the game more attractive. One way of implementing this is to alter the above B/A ratio to a B/C/A ratio, for example 75/5/20, in which the C-portion or 5%-portion is accumulated in the coin store 8 for giving a jackpot pay-out prize which brings the average long term pay-out back to the stipulated B % or 80%.

In FIG. 1*b* the superior program set by the setting device 11 is indicated by the block 20, which is further disignated by "mode of operation".

The block 20 indicated "mode of operation" controls three different blocks disignated 21 "setting of long term profit (%)", 22 "setting of long term pay-out (%)", 23 "setting of jackpot pay-out (%)". By using the computer unit 4 it is also possible to program a variation in the number of games from one jackpot to the next, so as to make it practically impossible for a player to follow a larger number of games in order to detect a possible sequence in the appearance of any jackpot pay-out prizes. Such random presence of the jackpot prizes might be implemented by means of a random generator 24 which in FIG. 1*b* is shown connected to the "mode of operation" block 20 to receive information therefrom, and which has its output connected to a monitoring unit 25 which also receive information from the above described blocks 21, 22 and 23, as well as from the block 26 designated "sensor signal receiving unit". The monitoring unit 25 monitores the dispenser mechanism 9 which, as described above, initiate the paying out of the correct number of coins, all in accordance with the mode of operation in which the computer unit 4 has been set.

Figure 2A:
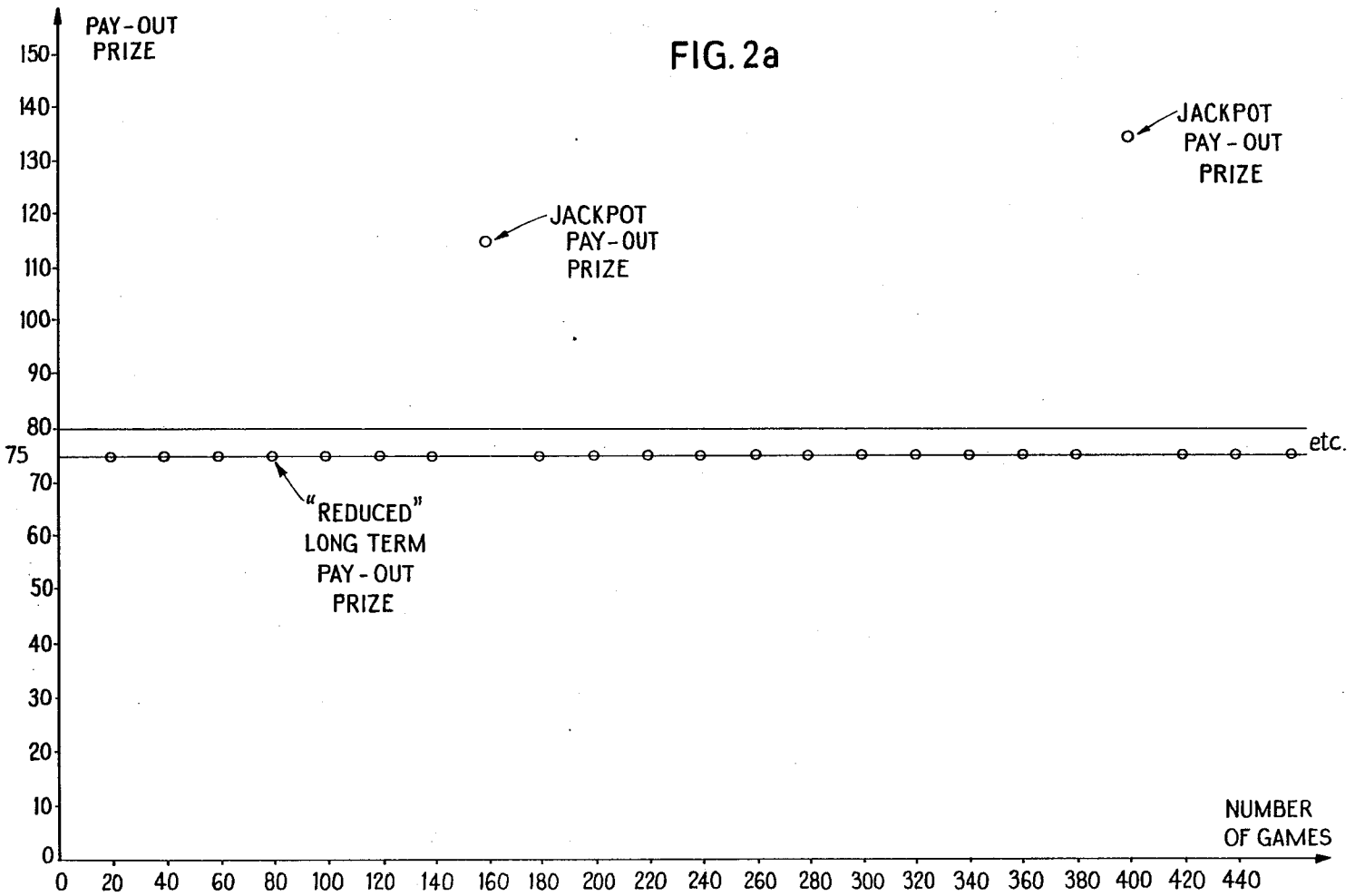
Figure 2B:
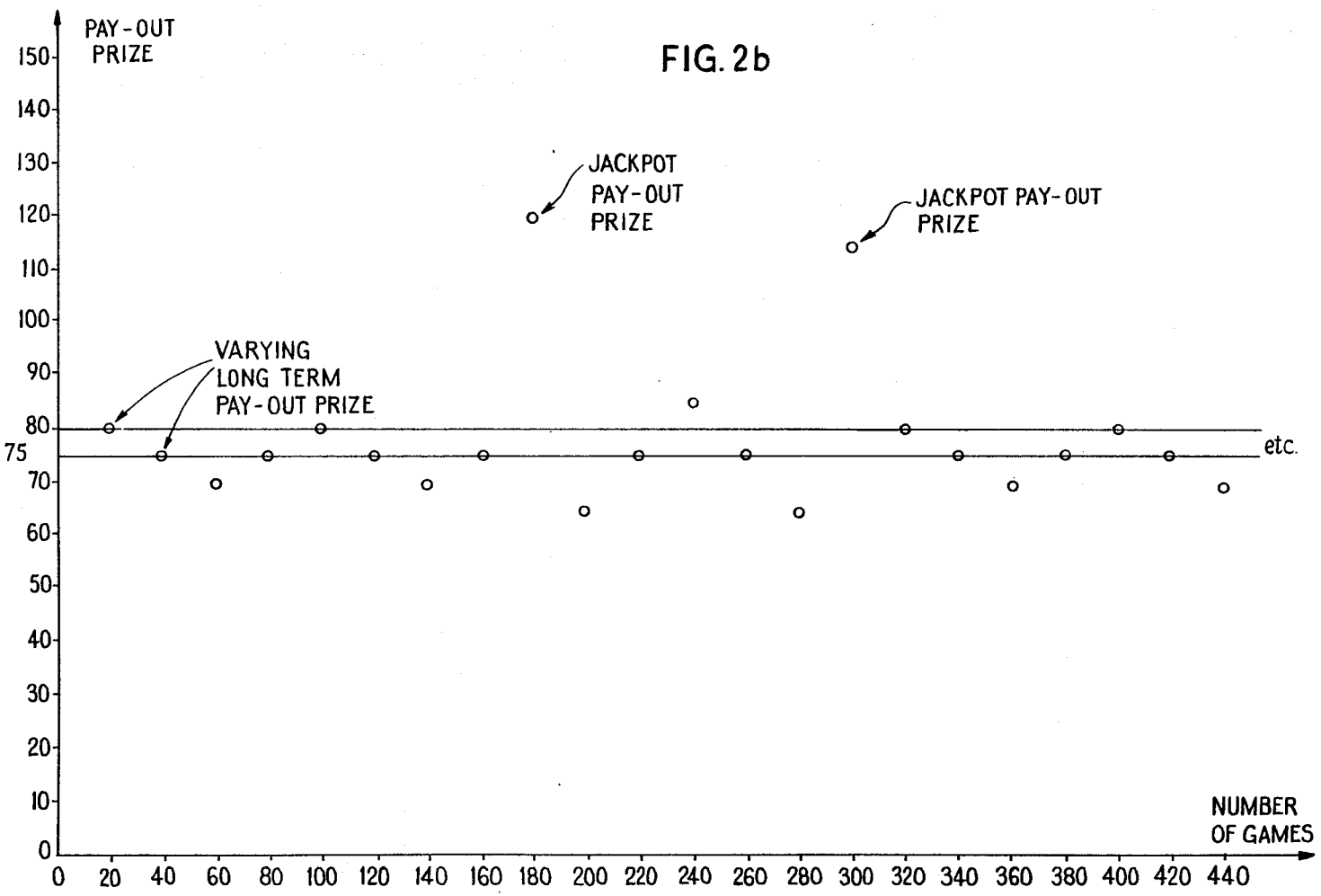

In FIGS. 2*a* and 2*b* there are illustrated examples of what can be achived with the aprovement in a coin-release gaming machine according to the invention.

In FIG. 2*a* the abscissa of the graph illustrates the number of games, whereas the ordinate depicts the individual pay-out prizes given by the setting or mode of operation of the computer unit 4. In order to simplify the example it is assumed only one pay-out slot. Further, it is assumed that the probability for hitting this payout slot is 5%, and that this probability of hitting the slot is met by hitting the slot after each twentieth game, which in fact is a very coarse simplification. Besides, the estimated probabillity is in this connection extremely low.

It is further assumed that the value of the coin is 5, such that upon game number 20, which according to the above assumptions will render pay-out, there is a short moment a value amounting to 100 in the coin store 8 of the machine 1*a* (in addition to a previous, unspecified amount). The first pay-out prize which will occure at game number twenty, can for example be programmed to be fixed at a percentage B amounting to 75, i.e. on a "lowered" average. After a certain number of such pay-out prizes, i.e. seven prizes there will at game number 160 appear a jackpot pay-out prize amount to 115, which thereby brings the average pay-out up to 80.

The number of games which have to be played before a jackpot occure, can for example be determined in accordance with the output from the random generator 24 included in the computer unit 4. In FIG. 2*a* there is indicated another jackpot after further 11 normal long term pay-out prizes, the occurrance thereof being at game number 400, and the jackpot there having been accumulated to a value of 135.

In effect, the manner in which the pay-out is effected will be much more complicated than explained above, the reasons thereof being as follows:

Firstly, there are usually involved a plurality of pay-out slots having different pay-out prizes. In case of five pay-out slots the ratio between the pay-out prizes might for example be represented by the figures 3-5-7-5-3, the middle slot being designed for maximum pay-out prize.- The computer unit 4 will however calculate the probability of pay-out prize for each game, and then with a distribution between the various slots as close to the desired distribution as possible.

Due to the plurality of possibilities of pay-out prizes the picture illustrated in FIG. 2*a* will be much more complicated, since the pay-out prize in question depends on which slot is hit by a coin. Thus, the accumulation of a jackpot prize might be much more rapid when a slot of lower order is hit, in which the long term pay-out prize is relativly lower than that compared with the middle slot. However, this is taken care of by the computer unit 4 which at any time receives the processes information about the contents of the coin store 8. The computer unit can also be set to aprepare a jackpot when a predetermined number of games have been played after the previous jackpot prize, provided the random generator 24 has not ordered a jackpot prize earlier.

Secondly, the casualty as regards the point of time when hitting any slot will result in that the pay-out prizes will be dispensed in a more random by manner than illustrated in FIG. 2*a*. In principal this will not be any drawback since the computer unit can also cater for these conditions. However, the computer unit 4 will be able to analyze the statistic distribution of hits, and by the registration of statistic significant deviations from the given preconditions for average profit over a great number of games, be able to close the gaming machine for readjustment of the program parameters.

The computer unit 4 is also able to be set for further variations of the size and the occurance of the pay-out prizes. The computer unit 4 can for example in accordance with a preferred setting make a change in which slot is to initiate the dispense of the highest pay-out prize. Besides, further variations in relation to what is illustrated in FIG. 2*a* can be set as regards the size of the pay-out prizes, as this is illustrated in FIG. 2*b*.

In FIG. 2*b* there is chosen a sinus-like variation of the long term pay-out prizes around the "lowered" average of 75%, including jackpot prizes which appearch in a similar manner as discussed in connection with FIG. 2*a*. It should be noted that the same simplifications as discussed above are also assumed in connection with FIG. 2*b*. In the example illustrated in FIG. 2*b* the amplitude of the "sine"-variations between each jackpot is also altered to render further variation in the game.

The pay-out prizes rendered possible by each game are calculated at any time by the computer unit 4 and are presented on the display units 2, such that prior to a game the user can see what chances are available for the coming game. The player can then be confronted with the possibility that the chances will vary from one game to the next, and in certain cases these changes might be drastic.

A lowermost pay-out limit must necessarily be set by the setting device 11, such that the gaming machine does not loose its attraction at any time.

The inner structure of the computer unit 4 might be provided in accordance with normal microprocessor and data technics, and the setting, mode of operations and programs to be used can either be implemented as relaycircuitry, logic elements, printed circuit boards, or softwear programming, the selection thereof being dependent upon the field of application and the physical size of the gaming machine itself.

As appearing from the above description which only describes a few examples of embodiments, the improvement according to the present invention will meet all the objects listed in the preamble of the specification.

Further, the improvement according to the invention makes it possible to vary the pay-out prizes in a far more interesting way than previously, and the improvement also takes care of the fact that the average profit and the average pay-out prizes can be maintained without a frequent readjustment of the control circuitry. With the present improvement the coin-released gaming machine associated therewith might in principle be made selfadjusting within certain limits.

It is to be understood that further embodiments including the improvement according to the invention can be implemented over and above the embodiments illustrated herein, the spirit and the scope of the present invention being defind by the appending claims.

What is claimed is:

1. In a coin-released gaming machine having a number of pay-out slots arranged in a coin panel, into which coin panel a user shoots a coin in an attempt to hit one of said pay-out slots, the hitting of any of said pay-out slots with a coin triggering a dispenser mechanism to portion out a certain number of coins stored in said machine for the pay-out of a prize, whereas missing any of said pay-out slots brings the used coin into a coin store, the improvement comprising in combination:

(a) means for monitoring the total value of prizes paid out;

(b) means for setting a long term profit;

(c) means for setting a long term pay-out prize; and (d) means for setting a special pay-out prize larger than said long term pay-out prize.

2. Machine as claimed in claim 1, wherein said means for setting a long term profit is adapted to give a long term average profit of a first percentage of the total number of coins received in said machine, said means for setting a long term pay-out prize is adapted to give a pay-out prize which in percentage is smaller than the balance between said first long term average profit percentage and the total number of coins received in said machine, and said means for setting a special pay-out prize is adapted to accumulate the difference between said balance and said long term pay-out prize, whereby, after a given number of succeeding games, the accumulated difference will be paid out as a jackpot prize.

3. Machine as claimed in claim 2, wherein said means for setting said special pay-out prize is adapted to pay-out said jackpot prize according to the occurrence of a randomly varying number of usual long term pay-out prizes.

4. Machine as claimed in claim 1, wherein the means for setting a long term pay-out prize is adapted to bring forth a pay-out prize varying below and above an average smaller pay-out prize, and the means for setting the special jackpot prize is adapted to accumulate the average values of said smaller pay-out prizes for the bringing forth of a jackpot prize.

5. Machine as claimed in claim 1, wherein the setting of the percentages related to means (b), (c), (d) of claim 2, is 75%/5%/20%, in which the 5% term is accumulated to constitute a jackpot pay-out prize.

6. Machine as claimed in claim 1, wherein the pay-out prize is made dependent upon the pay-out slot which is hit by a coin, said means for setting the long term pay-out prize being adapted for computing the pay-out prize in relation to the location of the slot in question as well as the statistically computed prerequisites of average profit.

7. Machine as claimed in claim 1, wherein is provided a plurality of display units, each unit being arranged adjacent a corresponding pay-out slot for indicating the value of the pay-out prize in question for each slot.

8. Machine as claimed in claim 1, wherein said means for setting a long term pay-out prize includes a limit for lowest value.

9. Machine as claimed in claim 1, wherein sad means of claim 1 is included in an on-line programmable processing unit.

* * * * *